US012589278B2

(12) United States Patent
Nakawaki

(10) Patent No.: US 12,589,278 B2
(45) Date of Patent: Mar. 31, 2026

(54) MEASUREMENT APPARATUS AND STORAGE MEDIUM

(71) Applicant: OMRON HEALTHCARE CO., LTD., Muko (JP)

(72) Inventor: Nozomi Nakawaki, Kyoto (JP)

(73) Assignee: OMRON HEALTHCARE CO., LTD., Kyoto (JP)

( * ) Notice: Subject to any disclaimer, the term of this patent is extended or adjusted under 35 U.S.C. 154(b) by 83 days.

(21) Appl. No.: 18/591,990

(22) Filed: Feb. 29, 2024

(65) Prior Publication Data

US 2024/0198176 A1 Jun. 20, 2024

Related U.S. Application Data

(63) Continuation of application No. PCT/JP2023/004208, filed on Feb. 8, 2023.

(30) Foreign Application Priority Data

Jul. 22, 2022 (JP) ..... 2022-117161

(51) Int. Cl.
*G08B 23/00* (2006.01)
*A63B 24/00* (2006.01)

(52) U.S. Cl.
CPC ..... *A63B 24/0062* (2013.01); *A63B 2225/50* (2013.01)

(58) Field of Classification Search
CPC ..... A63B 24/0062; A63B 2225/50; A61B 2562/0219; A61B 5/0004; A61B 5/1118;
(Continued)

(56) References Cited

U.S. PATENT DOCUMENTS 6,898,550 B1 * 5/2005 Blackadar ..... A61B 5/6895 702/182
9,641,991 B2 * 5/2017 Pitis ..... H04W 4/18
(Continued)

FOREIGN PATENT DOCUMENTS

CN 210809554 U 6/2020
JP 2009-240530 A 10/2009
(Continued)

OTHER PUBLICATIONS

Official Communication issued in International Patent Application No. PCT/JP2023/004208, mailed on May 9, 2023.
(Continued)

*Primary Examiner* — Toan N Pham
(74) *Attorney, Agent, or Firm* — Keating & Bennett, LLP

(57) ABSTRACT

A wearable measurement apparatus includes: a wireless communication interface configured to execute wireless communication with an information terminal; a detector configured to detect a stationary state of the measurement apparatus; and a controller configured to cause the wireless communication interface to transmit an advertisement signal for receiving, from the information terminal, a connection request to switch to one-to-one connection communication between the measurement apparatus and the information terminal in response to the stationary state being detected by the detector.

6 Claims, 8 Drawing Sheets

(58) Field of Classification Search
CPC ..... A61B 5/1123; A61B 5/681; A61B 2560/0209; G16H 20/30; G16H 40/67; G16H 40/63
See application file for complete search history.

(56) References Cited

U.S. PATENT DOCUMENTS

| | | | | |
|---|---|---|---|---|
| 9,662,053 | B2 * | 5/2017 | Richards | A61B 5/002 |
| 9,940,682 | B2 * | 4/2018 | Hoffman | A63B 24/0062 |
| 11,412,348 | B2 * | 8/2022 | Ferreira | H04W 4/027 |
| 2008/0016961 | A1 | 1/2008 | Dwyer et al. | |
| 2016/0023043 | A1 | 1/2016 | Grundy | |
| 2016/0119879 | A1 | 4/2016 | Okamoto | |
| 2018/0109852 | A1 | 4/2018 | Mandapaka et al. | |
| 2018/0110077 | A1 | 4/2018 | Mandapaka et al. | |
| 2018/0110078 | A1 | 4/2018 | Mandapaka et al. | |
| 2019/0394638 | A1 | 12/2019 | Iida | |
| 2021/0204088 | A1 | 7/2021 | Ferreira et al. | |
| 2021/0212132 | A1 | 7/2021 | Mandapaka et al. | |
| 2021/0271433 | A1 | 9/2021 | Hirai | |
| 2021/0302595 | A1 | 9/2021 | Aruga | |
| 2022/0086923 | A1 | 3/2022 | Mandapaka et al. | |
| 2023/0089907 | A1 | 3/2023 | Mandapaka et al. | |
| 2024/0108290 | A1 * | 4/2024 | Jeon | A61B 5/0022 |

FOREIGN PATENT DOCUMENTS

| | | | |
|---|---|---|---|
| JP | 2010-093613 | A | 4/2010 |
| JP | 2014229927 | A | 12/2014 |
| JP | 2015-159978 | A | 9/2015 |
| JP | 2016202661 | A | 12/2016 |
| JP | 2019220890 | A | 12/2019 |
| JP | 2021141365 | A | 9/2021 |
| JP | 2021156825 | A | 10/2021 |
| JP | 2022-058553 | A | 4/2022 |

OTHER PUBLICATIONS

Official Communication issued in corresponding Japanese Patent Application No. 2022-117161, mailed on Nov. 11, 2025, 4 pages.

* cited by examiner

MEASUREMENT APPARATUS AND STORAGE MEDIUM

CROSS-REFERENCE TO RELATED APPLICATIONS

This application is a continuation of PCT application No. PCT/JP2023/004208, which was filed on Feb. 8, 2023 based on Japanese Patent Application No. 2022-117161 filed on Jul. 22, 2022, the contents of which are incorporated herein by way of reference.

BACKGROUND

The present disclosure relates to a measurement apparatus and a storage medium storing a control program.

In the related art, there has been known a biological information measurement apparatus that forms a wireless communication link using Bluetooth (registered trademark) with an external terminal and that transmits biological information measured by a measurement unit to the external terminal via this communication link (JP2009-240530A).

According to the biological information measurement apparatus in JP2009-240530A, when biological information is measured by the measurement unit such as a blood pressure monitor, the communication link is temporarily released so that a frequency signal of the communication link does not become noise for the measurement of the measurement unit. After the measurement of the measurement unit has been completed, the communication link is restarted and measurement data is transmitted to the external terminal via the communication link.

In this way, the biological information measurement apparatus in JP2009-240530A controls the state of the communication link from the viewpoint of noise countermeasures when measuring biological information. The biological information measurement apparatus in JP2009-240530A relates to control of a non-wearable measurement apparatus for measuring biological information of a user. Therefore, the biological information measurement apparatus in JP2009-240530A does not describe control of a wearable measurement apparatus.

Aspects of the present disclosure relates to providing a measurement apparatus and a storage medium storing a control program that are capable of improving user convenience in a wearable measurement apparatus and reducing power consumption.

SUMMARY

According to an aspect of the present disclosure, there is provided a wearable measurement apparatus includes: a wireless communication interface configured to execute wireless communication with an information terminal; a detector configured to detect a stationary state of the measurement apparatus; and a controller configured to cause the wireless communication interface to transmit an advertisement signal for receiving, from the information terminal, a connection request to switch to one-to-one connection communication between the measurement apparatus and the information terminal in response to the stationary state being detected by the detector.

DESCRIPTION OF EMBODIMENTS

Hereinafter, an embodiment according to an aspect of the present disclosure will be described with reference to the drawings.

§ 1 Application Example

<Information Management System 100>

Figure 1:
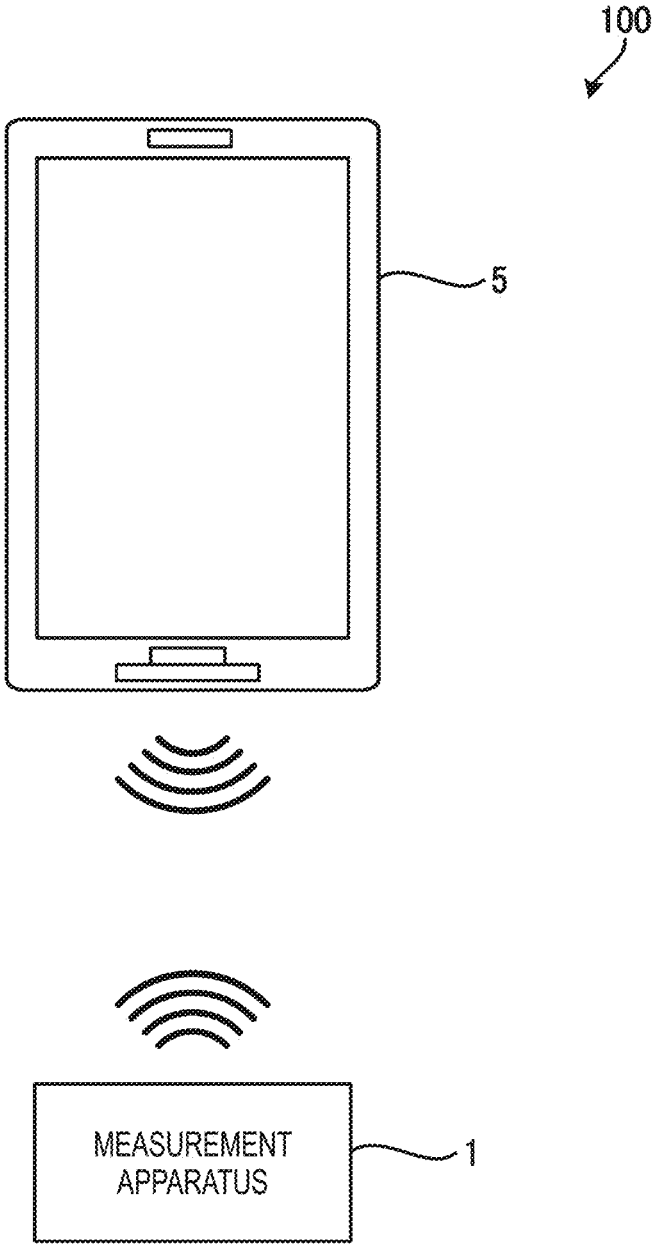
FIG. 1 is a diagram showing an information management system 100 including a measurement apparatus 1 according to the present invention and an information terminal 5 that executes wireless communication with the measurement apparatus 1.

FIG. 1 shows an information management system 100 including a measurement apparatus 1 according to the present disclosure and an information terminal 5 that executes wireless communication with the measurement apparatus 1.

The measurement apparatus 1 includes an activity amount measurement apparatus that measures an activity amount such as the number of steps, the walking distance, or the calorie consumption. The measurement apparatus 1 includes a measurement sensor that measures the amount to be measured. The amount to be measured by a measurement sensor includes the activity amount such as the number of steps, the traveled distance, or the calorie consumption according to the measurement apparatus 1. The measurement apparatus 1 is a wearable measurement apparatus. The wearable measurement apparatus 1 is a measurement apparatus such as an activity amount meter that is carried by being worn on the body of the user. In contrast to the wearable measurement apparatus, a measurement apparatus that is not wearable is referred to as a non-wearable measurement apparatus. The non-wearable measurement apparatus is a measurement apparatus (for example, a body weight meter, a body composition meter, or a blood pressure monitor), which is used in the state of being provided on the ground or on the stand. The measurement apparatus 1 transmits the measured activity amount as management measurement information of the user to the information terminal 5 by wireless communication.

The information terminal 5 stores the management measurement information received from the measurement apparatus 1 in a data storage unit in the information terminal 5. The information terminal 5 may execute wireless communication with a device other than the measurement apparatus 1, and stores information acquired from an external device in the data storage unit in the information terminal 5. The information terminal 5 is an information processing device that analyzes various types of information acquired from the measurement apparatus 1 and other external devices. The information terminal 5 is a terminal including a display such as a smartphone, a tablet terminal, a notebook computer, a desktop computer, or a wearable terminal. The information terminal 5 may be set to acquire the management measurement information from the specific measurement apparatus 1. The specific measurement apparatus 1 that acquires the management measurement information may be registered in advance in the data storage unit of the information terminal 5.

Figure 2:
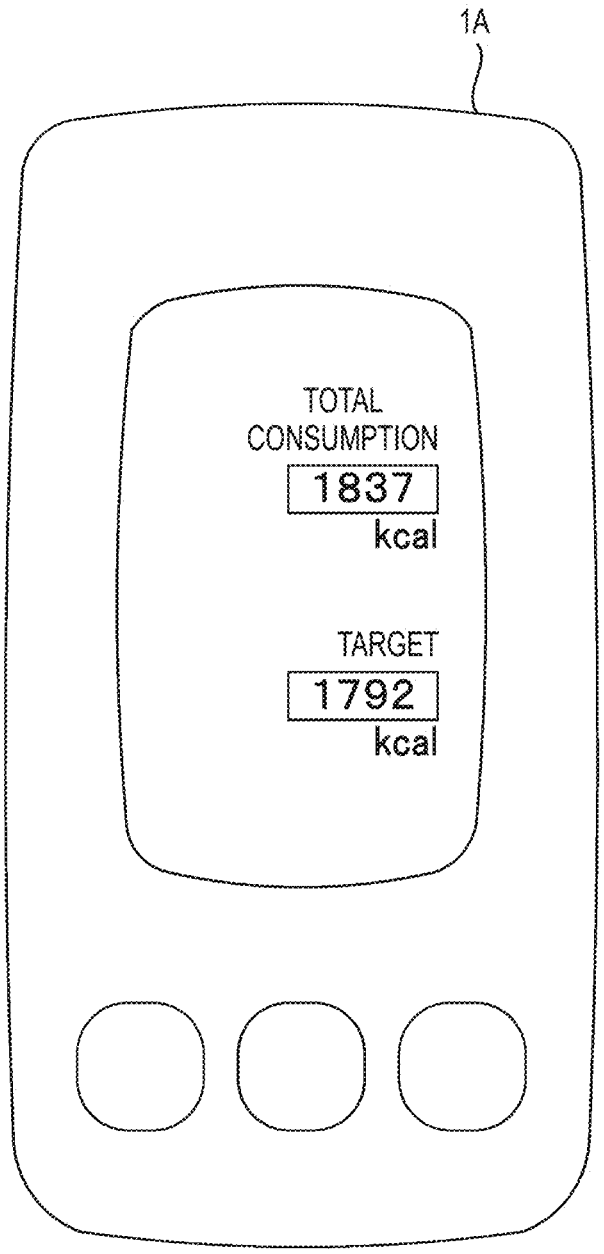
FIG. 2 is a diagram showing an activity amount meter 1A which is an example of the measurement apparatus 1.

FIG. 2 is a diagram showing an activity amount meter 1A which is an example of the measurement apparatus 1. The activity amount meter 1A is an example of the activity amount measurement apparatus, measures the movement of the body of the user due to walking, family work, desk work, or the like, outputs the calorie consumption for one day by the movement as a numerical value, and transmits the measurement result as the management measurement information of the user to the information terminal 5 by the wireless communication. For example, the activity amount meter 1A numerically displays, for example, the target calorie consumption of the user and the total calorie consumption consumed today on the screen. The activity amount meter 1A is a wearable measurement apparatus, and may extract an acceleration signal generated by the physical activity of the user from various noises. In addition to identifying walking or jogging, the activity amount meter 1A identifies daily movement such as the family work and the desk work, and measures the calorie consumption. The activity amount meter 1A can also measure the heart rate, the oxygen intake, and the like of the user. The activity amount meter 1A may be, for example, a wristwatch type device.

Figure 3:
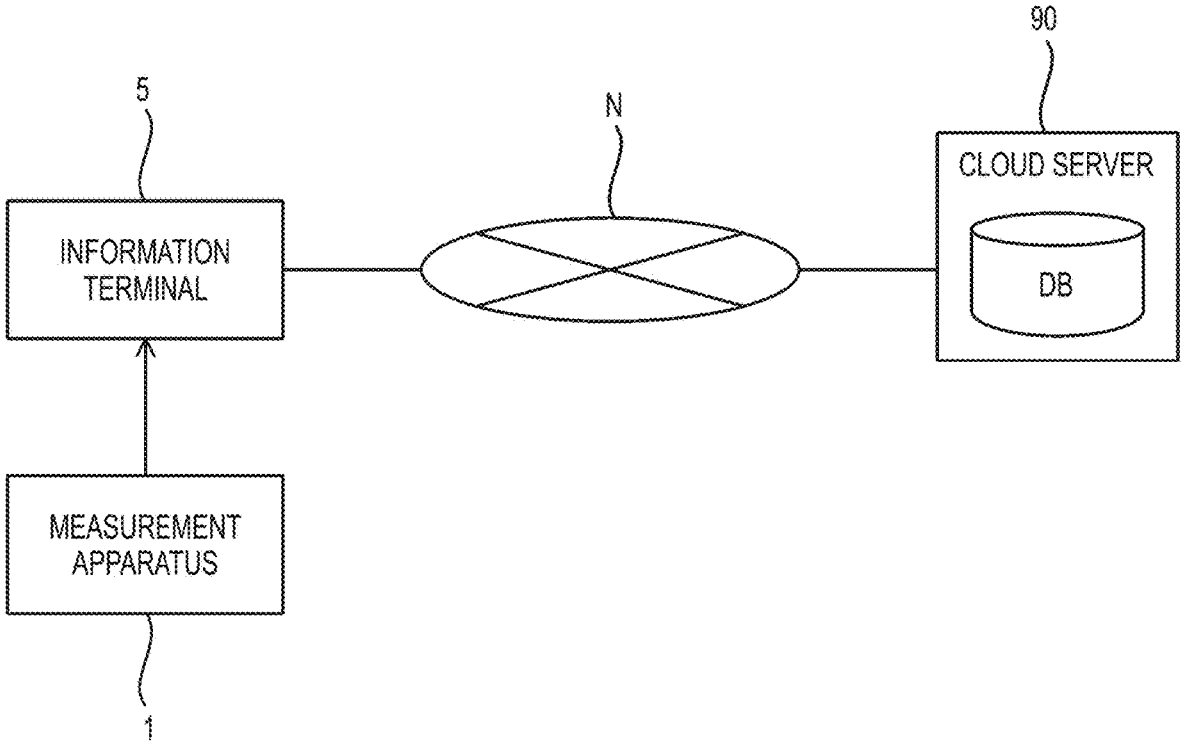
FIG. 3 is a diagram showing an example in which the information terminal 5 is connected to a network.

FIG. 3 is a diagram showing an example in which the information terminal 5 is connected to a network. As shown in FIG. 3, the information terminal 5 may be connected to a cloud server 90 via a wide area network N such as the Internet. The information terminal 5 may transmit the management measurement information stored therein to the cloud server 90 via the wide area network N and manage the management measurement information of the user as a database in the cloud server 90. The information terminal 5 may acquire the management measurement information managed in the cloud server 90 via the wide area network N and use the acquired management measurement information.

§ 2 Configuration Example

<Configuration of Measurement Apparatus 1>

Figure 4:
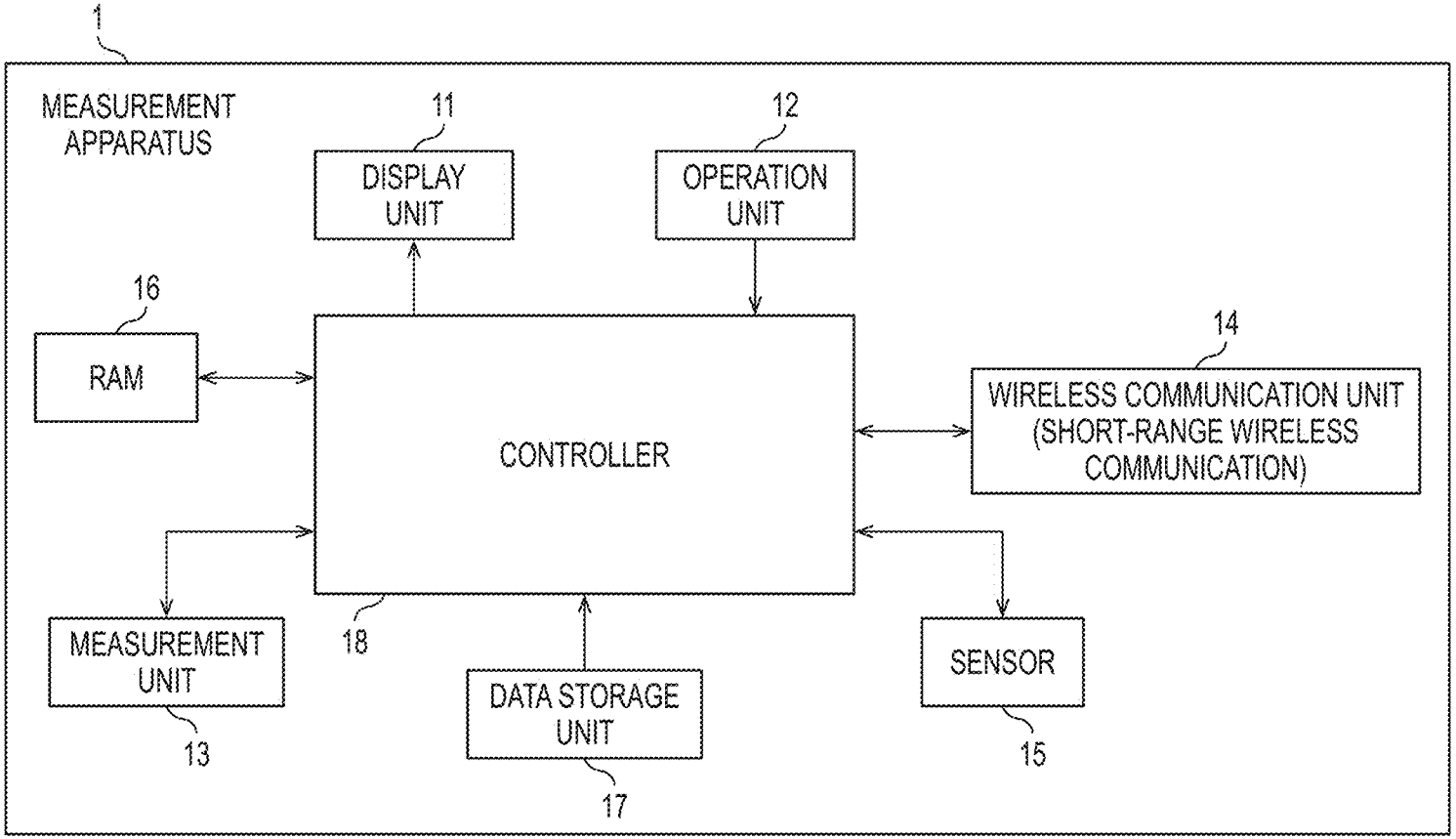
FIG. 4 is a block diagram showing the configuration of the measurement apparatus 1.

FIG. 4 is a block diagram showing the configuration of the measurement apparatus 1. The measurement apparatus 1 includes a display unit 11 that displays various types of information, an operation unit 12 operated by the user, a measurement unit 13 that measures the activity amount, a wireless communication unit 14 that executes communication with an external device, and a sensor 15 that detects a stationary state of the measurement apparatus 1. The measurement apparatus 1 also includes a RAM 16 that temporarily stores information, a data storage unit 17 that stores information and programs, and a controller 18 that controls the overall operation. The controller 18 is an example of a controller and a processor according to the present disclosure. The sensor 15 is an example of a detector according to the present disclosure.

The display unit 11 includes, for example, a liquid crystal display or an organic electro luminescence (EL) display. The operation unit 12 is a user interface such as a button or a touch panel that receives the user operation. The buttons include a button physically provided in the measurement apparatus 1 and a virtual button displayed on the display unit 11.

The measurement unit 13 measures the activity amount such as the number of steps, the walking distance, or the calorie consumption. What to measure differs depending on the object to be measured by the measurement apparatus 1.

The wireless communication unit 14 is a communication unit that executes short-range wireless communication, for example, a circuit (a module) that executes communication according to the Bluetooth Low Energy (BLE (registered trademark)) standard. The wireless communication unit 14 transmits an advertisement signal for executing wireless communication to an unspecified number of external devices by broadcast communication at a predetermined transmission cycle. The wireless communication unit 14 transmits the advertisement signal including, for example, the name and the attribute information of the measurement apparatus 1. The BLE communication executed by the wireless communication unit 14 is, for example, communication using 2.4 GHz frequency. The wireless communication unit 14 transmits the management measurement information such as the activity amount measured by the measurement unit 13 to the information terminal 5 by the BLE communication.

The sensor 15 is, for example, an acceleration sensor. The sensor 15 detects the stationary state of the measurement apparatus 1 (the own apparatus) due to stoppage of the activity when a user who is wearing the measurement apparatus 1 and is active stops the activity. The sensor 15 detects that the measurement apparatus 1 is stationary when the user wearing the measurement apparatus 1 removes the measurement apparatus 1 from the body of the user and places the measurement apparatus 1 on a desk or the like.

The RAM 16 includes, for example, a semiconductor device such as a DRAM or an SRAM, temporarily stores information, and serves as a work area of the controller 18.

The data storage unit 17 is a recording medium that stores parameters, a control program, management measurement information, and the like necessary for implementing predetermined processing. The data storage unit 17 includes, for example, a hard disk drive (HDD) or a semiconductor storage device (SSD).

The controller 18 implements the predetermined processing by executing a control program. In the present embodiment, for example, health management application software for the measurement apparatus is installed in advance as a control program in the data storage unit 17, and the controller 18 implements the predetermined processing by executing the health management application software.

For example, when the sensor 15 detects that the measurement apparatus 1 is stationary, the controller 18 controls the wireless communication unit 14 to transmit an advertisement signal for the wireless communication (the BLE communication). Specifically, when the controller 18 detects that the measurement apparatus 1 is stationary due to the stoppage of the activity of the user wearing the measurement apparatus 1, the controller 18 controls the wireless communication unit 14 to transmit the advertisement signal. The stoppage of the activity of the user includes, for example, stoppage of the movement of the body due to the walking, the family work, the desk work, or the like of the user. When the controller 18 detects that the measurement apparatus 1 is stationary due to due to the user wearing the measurement apparatus 1 removing the measurement apparatus 1, the controller 18 controls the wireless communication unit 14 to transmit the advertisement signal. On the other hand, when there is no transmission data to be transmitted to the information terminal 5, the controller 18 controls the wireless communication unit 14 to stop the transmission of the advertisement signal even when the measurement apparatus 1 is detected to be stationary.

<Configuration of Information Terminal 5>

Figure 5:
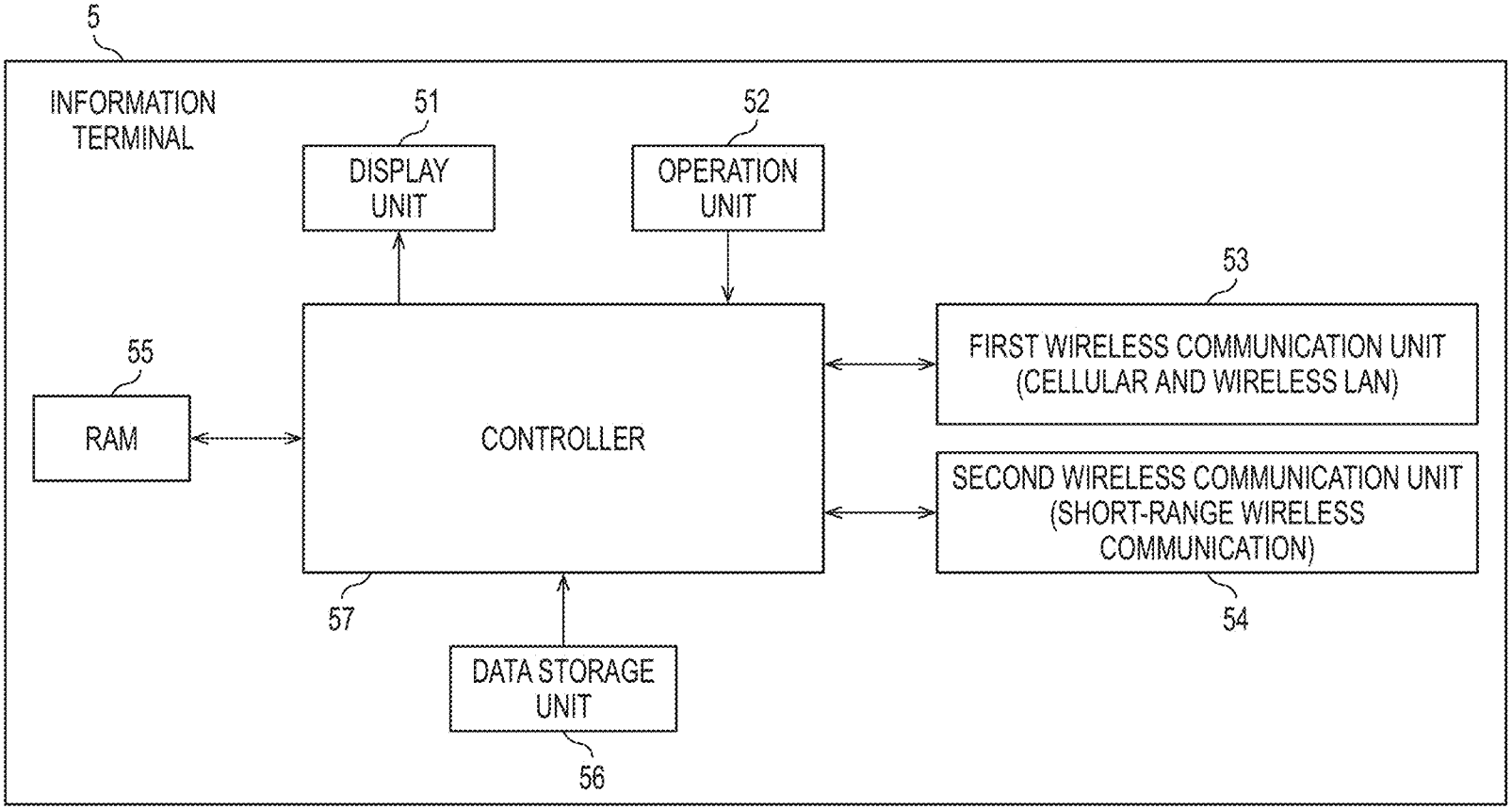
FIG. 5 is a block diagram showing the configuration of the information terminal 5.

FIG. 5 is a block diagram showing the configuration of the information terminal 5. The information terminal 5 includes a display unit 51 that displays various types of information, an operation unit 52 operated by the user, and a first wireless communication unit 53 and a second wireless communication unit 54 that execute communication with an external device. The information terminal 5 includes a RAM 55 that temporarily stores information, a data storage unit 56 that stores information and a program, and a controller 57 that controls the entire operation.

The display unit 51 includes, for example, a liquid crystal display or an organic EL display. The operation unit 52 is a user interface such as a button or a touch panel that receives the user operation. The buttons include a button physically provided on the information terminal 5 and a virtual button displayed on the display unit 51.

The first wireless communication unit 53 is a communication unit that executes cellular communication, for example, a circuit (a module) that executes communication according to standards such as 4G, 5G, and Long Term Evolution (LTE: registered trademark). The first wireless communication unit 53 is a communication unit that executes the wireless LAN communication, for example, a circuit (a module) that executes communication according to a standard such as Wi-Fi (registered trademark). The second wireless communication unit 54 is a communication unit that executes short-range wireless communication, for example, a circuit (a module) that executes communication according to the BLE standard.

For example, the second wireless communication unit 54 executes the BLE communication with the wireless communication unit 14 of the measurement apparatus 1 to acquire the management measurement information of the user measured by the measurement apparatus 1. By executing scanning, the second wireless communication unit 54 receives the advertisement signal transmitted from the wireless communication unit 14 of the measurement apparatus 1. The second wireless communication unit 54 recognizes the measurement apparatus 1 based on the received advertisement signal, and transmits a connection request to the measurement apparatus 1 when communication connection is desired. The measurement apparatus 1 waits for the connection request for the predetermined time after transmitting the advertisement signal, and when receiving the connection request within the predetermined time, stops transmitting the advertisement signal and switches to one-to-one connection communication with the connection request partner.

The RAM 55 includes, for example, a semiconductor device such as a DRAM or an SRAM, temporarily stores information, and serves as a work area of the controller 57.

The data storage unit 56 is a recording medium that stores parameters, a control program, management measurement information acquired from the measurement apparatus 1, and the like necessary for implementing predetermined processing. The data storage unit 56 includes, for example, a hard disk drive (HDD) or a semiconductor storage device (SSD).

The controller 57 implements the predetermined processing by executing a control program. In the present embodiment, for example, health management application software for an information terminal is installed in advance as a control program in the data storage unit 56, and the controller 57 implements the predetermined processing by executing the health management application software. For example, when the health management application software for an information terminal is started, the controller 57 controls the second wireless communication unit 54 to receive an advertisement signal by executing scanning. When the advertisement signal from the measurement apparatus 1 is received, the controller 57 transmits a connection request to the measurement apparatus 1 and controls the second wireless communication unit 54 to acquire the management measurement information from the measurement apparatus 1.

§ 3 Operation Example

<Operation of Measurement Apparatus 1>

Figure 6:
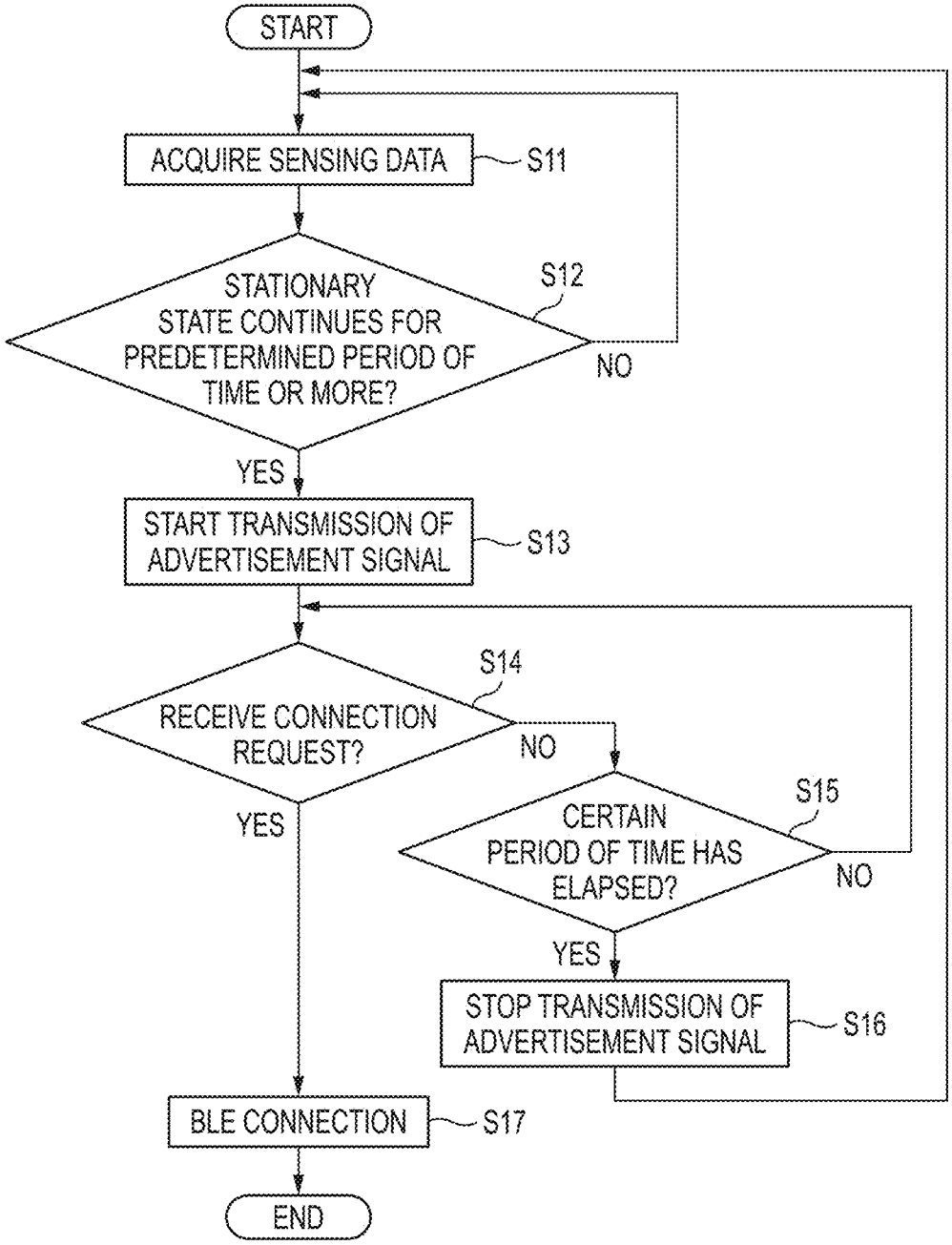
FIG. 6 is a flowchart showing a processing procedure of a controller 18 of the measurement apparatus 1.

Next, an operation example of the measurement apparatus 1 will be described with reference to FIG. 6. FIG. 6 is a flowchart showing a processing procedure of the controller 18 of the measurement apparatus 1. In this example, the measurement apparatus 1 will be described as the activity amount meter 1A. This processing is started when the power of the activity amount meter 1A is turned on.

The controller 18 of the activity amount meter 1A acquires, from the sensor 15, the sensing data collected by the sensor 15 (step S11).

The controller 18 determines, based on the sensing data acquired by the sensor 15, whether the activity amount meter 1A owned by the user is in the stationary state and whether the stationary state has continued for a predetermined period of time or more (step S12). As described above, the stationary state of the activity amount meter 1A includes a stationary state due to the user wearing the activity amount meter 1A stopping the activity, a stationary state due to the user wearing the activity amount meter 1A removing the activity amount meter 1A, and the like.

In step S12, when the stationary state of the activity amount meter 1A has not continued for the predetermined period of time or more (step S12: No), the controller 18 returns to step S11 and repeats the processing.

In step S12, when the stationary state of the activity amount meter 1A has continued for the predetermined period of time or more (step S12: Yes), the controller 18 controls the wireless communication unit 14 to start the transmission of the advertisement signal (step S13).

Next, the controller 18 determines whether a connection request to the activity amount meter 1A has been received from the external device after the transmission of the advertisement signal (step S14).

In step S14, when the connection request has not been received (step S14: No), the controller 18 determines whether a certain period of time set as time for receiving the connection request has elapsed (step S15).

In step S15, when the certain period of time has not elapsed (step S15: No), the controller 18 returns to step S14 and repeats the processing.

In step S15, when the certain period of time has elapsed (step S15: Yes), that is, when there is no connection request from the external device within the certain period of time, the controller 18 controls the wireless communication unit 14 to stop the transmission of the advertisement signal (step S16). After stopping the transmission of the advertisement signal, the controller 18 returns to step S11 and repeats the processing. That is, even when the controller 18 detects the stationary state of the activity amount meter 1A that has continued for the predetermined period of time or more and starts the transmission of the advertisement signal, if there is no connection request from the external device within the certain period of time, the controller 18 stops the transmission of the advertisement signal and returns to the processing of sensing the stationary state of the activity amount meter 1A by the sensor 15. After step S16, when a certain period of time has elapsed since the start of the processing in FIG. 6 or when the number of times of execution of step S16 exceeds a certain number of times, the controller 18 may end the series of processing in FIG. 6 without returning to step S11. Accordingly, it is possible to prevent the transmission of the advertisement signal from being endlessly repeated when there is no connection request.

On the other hand, in step S14, when the connection request is received (step S14: Yes), the controller 18 stops the transmission of the advertisement signal, and starts communication via the BLE connection with the external device that has transmitted the connection request signal (step S17). The external device that makes a connection request is a device that has received the advertisement signal from the activity amount meter 1A, is a device capable of BLE communication with the activity amount meter 1A, and may be a plurality of external devices around the activity amount meter 1A.

In the processing procedure shown in FIG. 6, an example has been described in which the transmission of the advertisement signal is started when the stationary state of the activity amount meter 1A is detected. Alternatively, for example, the activity amount meter 1A may transmit the advertisement signal based on a predetermined condition even when the stationary state of the activity amount meter 1A is not detected. Specifically, when the communication button provided in the activity amount meter 1A is pressed for a long time (for example, pressed for 2 seconds), the processing may proceed to the processing in step S13 described above, the transmission of the advertisement signal may be started, and the subsequent processing may be executed.

<Operation of Information Management System 100>

Figure 7:
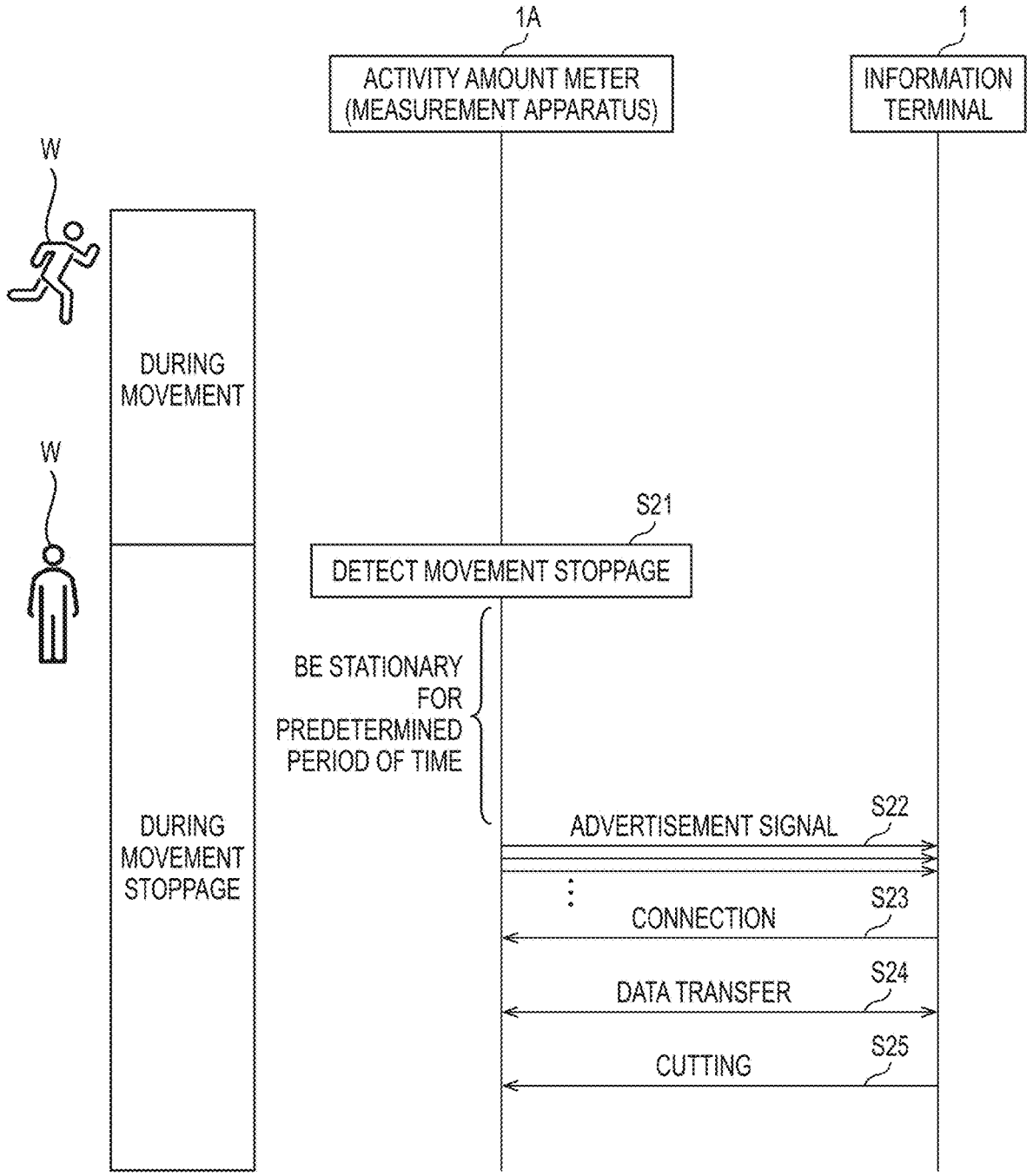
FIG. 7 is a sequence diagram showing an operation example of the information management system 100.

Next, an operation example of the information management system 100 will be described with reference to FIG. 7. FIG. 7 is a sequence diagram showing operations of the measurement apparatus 1 and the information terminal 5 in the information management system 100. In this example, the measurement apparatus 1 will also be described as the activity amount meter 1A.

It is assumed that the user W wearing the activity amount meter 1A is, for example, jogging. The activity amount meter 1A measures activity amount data of the user W due to jogging by the measurement unit 13, and stores the measured activity data as the management measurement information in the data storage unit 17.

The activity amount meter 1A detects the stationary state of the activity amount meter 1A based on the sensing data acquired by the sensor 15, and detects that the user W wearing the activity amount meter 1A stops jogging based on the stationary state of the activity amount meter 1A (step S21). The activity amount meter 1A determines whether the jogging stop state of the user W has continued for a predetermined period of time, and when determining that the stop state has continued for the predetermined period of time, the activity amount meter 1A starts the transmission of the advertisement signal (step S22).

When the health management application is started, the information terminal 5 receives the advertisement signal from the activity amount meter 1A by executing scanning. Upon receiving the advertisement signal from the activity amount meter 1A, the information terminal 5 transmits the connection request signal for requesting connection of communication to the activity amount meter 1A (step S23).

When the activity amount meter 1A receives the connection request from the information terminal 5, the activity amount meter 1A stops the transmission of the advertisement signal and switches to the one-to-one connection communication with the information terminal 5. Accordingly, the activity amount meter 1A and the information terminal 5 are in a BLE connection state. The activity amount meter 1A transfers the measured management measurement information of the user W to the information terminal 5 by the BLE communication (step S24).

After receiving the management measurement information, the information terminal 5 transmits a disconnection request signal for requesting disconnection of the BLE communication to the activity amount meter 1A (step S25). When the activity amount meter 1A that has received the disconnection request disconnects the BLE connection with the information terminal 5, the communication therebetween ends.

<Modified Operation Example of Measurement Apparatus 1>

Next, a modified operation example of the measurement apparatus 1 will be described with reference to the flowchart in FIG. 8. In this example, the measurement apparatus 1 will also be described as the activity amount meter 1A. The processing in this example is also started when the power of the activity amount meter 1A is turned on, similarly to the processing in FIG. 6 described above.

The controller 18 of the activity amount meter 1A determines whether there is untransmitted data, that is, whether the measured activity amount data is stored in the data storage unit 17 without being transmitted (step S31). When there is no untransmitted data (step S31: No), the controller 18 waits while repeating the processing of step S31.

In step S31, when there is untransmitted data (step S31: Yes), the controller 18 acquires, from the sensor 15, sensing data collected by the sensor 15 (step S32).

Figure 8:
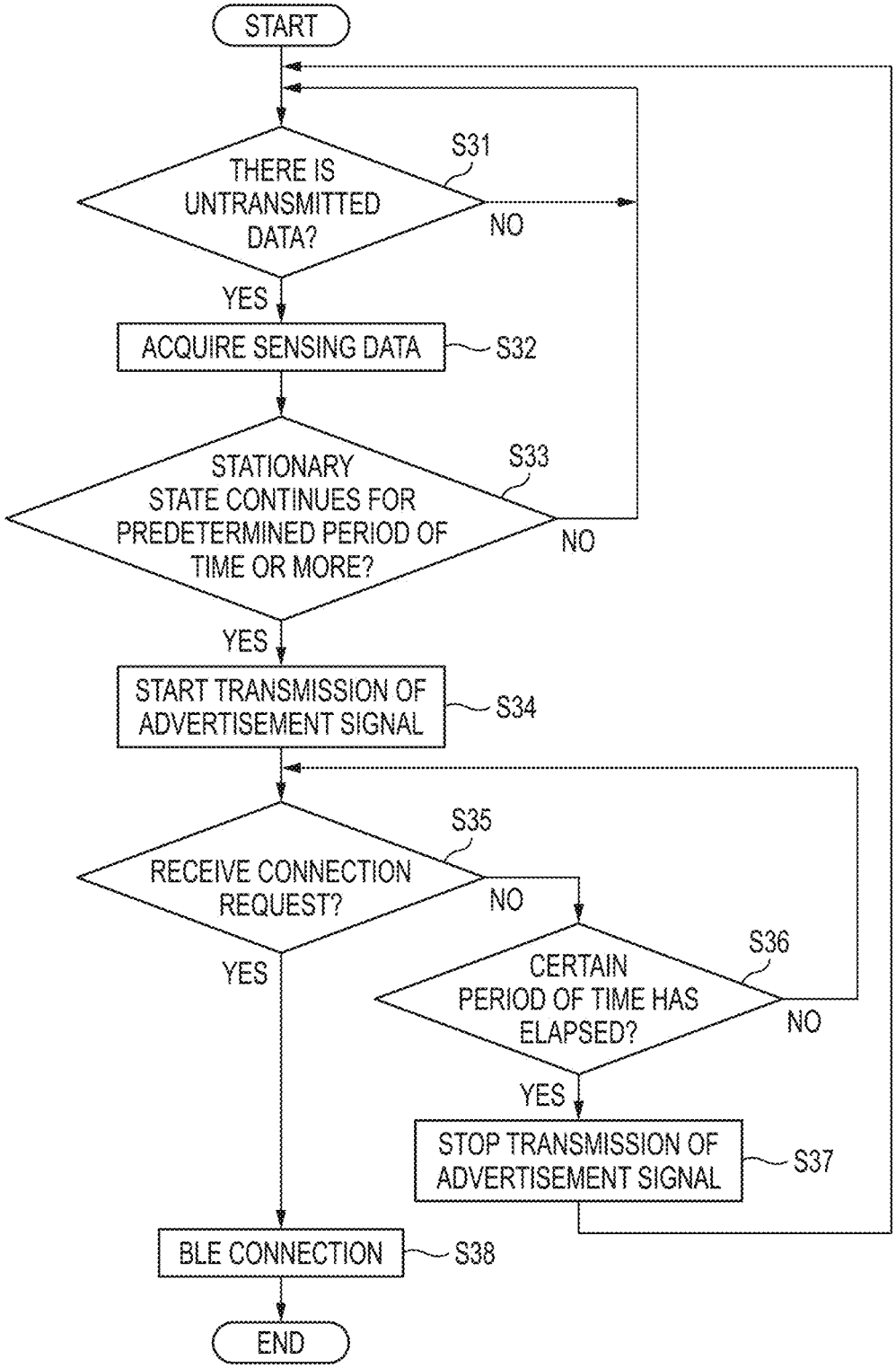
FIG. 8 is a flowchart showing a modification of the processing procedure of the controller 18 of the measurement apparatus 1.

As shown in FIG. 8, in the modified operation example of the activity amount meter 1A, the processing from step S32 to step S38 is the same as the processing from step S11 to step S17 of the operation example shown in FIG. 6, and thus the description of the processing of these steps is omitted. After step S37, when a certain period of time has elapsed since the start of the processing in FIG. 8 or when the number of times of execution of step S37 exceeds a certain number of times, the controller 18 may end the series of processing in FIG. 8 without returning to step S31. Accordingly, it is possible to prevent the transmission of the advertisement signal from being endlessly repeated when there is no connection request.

As described above, when the activity amount meter 1A does not have untransmitted data, the controller 18 of the activity amount meter 1A executes control so as not to transmit the advertisement signal even when the activity amount meter 1A of the user is in the stationary state.

As described above, when the sensor 15 detects the stationary state of the measurement apparatus 1, the measurement apparatus 1 causes the controller 18 to transmit the advertisement signal for the wireless communication (the BLE communication) to the wireless communication unit 14. Accordingly, when it is detected that the state of the measurement apparatus 1 becomes the stationary state, the advertisement signal for automatically starting the BLE communication is transmitted. Therefore, it is possible to transmit the advertisement signal without requiring a specific operation (for example, a long press operation of the communication button) performed by the user, and the convenience is improved. When the measurement apparatus 1 is not in the stop state, the sensor 15 only needs to detect the state of the measurement apparatus 1 without transmitting the advertisement signal. Therefore, it is possible to reduce the transmission period of the advertisement signal and to reduce the power consumption.

For example, the controller 18 of the measurement apparatus 1 transmits the advertisement signal when detecting that the measurement apparatus 1 is stationary due to the user wearing the measurement apparatus 1 stopping the activity or when detecting that the measurement apparatus 1 is stationary due to the user wearing the measurement apparatus 1 removing the measurement apparatus 1. Accordingly, since the measurement apparatus 1 and the information terminal 5 may be set in the connection state of the BLE communication, it is possible to smoothly transfer measurement data, which is often executed when the user stops the activity or when the measurement apparatus 1 is removed from the user.

When there is no transmission data to be transmitted to the information terminal 5, the controller 18 of the measurement apparatus 1 stops the transmission of the advertisement signal even when the stop state of the measurement apparatus 1 is detected. Accordingly, it is possible to reduce the transmission period of the advertisement signal transmitted from the measurement apparatus 1 and to reduce the power consumption.

§ 4 Modification

Based on the sensing pattern of the sensor 15 specific to the situation, the controller 18 of the measurement apparatus 1 may detect that the measurement apparatus 1 is stationary due to the user wearing the measurement apparatus 1 stopping the activity or detect that the measurement apparatus 1 is stationary due to the user wearing the measurement apparatus 1 removing the measurement apparatus 1. Accordingly, it is possible to accurately detect that the measurement apparatus 1 is stationary due to the user wearing the measurement apparatus 1 stopping the activity or to accurately detect that the measurement apparatus 1 is stationary due to the user wearing the measurement apparatus 1 removing the measurement apparatus 1.

For example, the data storage unit 17 stores a sensing pattern (for example, a pattern of being stationary immediately after the sensing pattern specific to the activity of the user such as jogging) of the sensor 15 when the measurement apparatus 1 is stationary due to the user wearing the measurement apparatus 1 stopping the activity. The sensing pattern may be stored in the data storage unit 17 in advance when the measurement apparatus 1 is manufactured, or may be generated according to the user and stored in the data storage unit 17 after the measurement apparatus 1 has been manufactured. Then, by comparing the sensing pattern stored in the data storage unit 17 with the sensing pattern obtained by the sensor 15, the controller 18 detects that the measurement apparatus 1 is stationary due to the user wearing the measurement apparatus 1 stopping the activity.

For example, the data storage unit 17 stores a sensing pattern (for example, a pattern of being stationary immediately after the sensing pattern specific to the case in which the measurement apparatus 1 is removed) of the sensor 15 when the measurement apparatus 1 is stationary due to the user wearing the measurement apparatus 1 removing the measurement apparatus 1. The sensing pattern may be stored in the data storage unit 17 in advance when the measurement apparatus 1 is manufactured, or may be generated according to the user and stored in the data storage unit 17 after the measurement apparatus 1 has been manufactured. Then, by comparing the sensing pattern stored in the data storage unit 17 with the sensing pattern obtained by the sensor 15, the controller 18 detects that the measurement apparatus 1 is stationary due to the user wearing the measurement apparatus 1 removing the measurement apparatus 1.

§ 5 Program

The method for controlling the measurement apparatus 1 described in the above embodiment may be achieved by executing a control program prepared in advance on a computer. The control program is stored in a computer-readable storage medium and is executed by being read from the storage medium. The control program may be provided in a form stored in a non-transitory storage medium such as a flash memory, or may be provided via a network such as the Internet. The computer that executes the control program may be provided in the measurement apparatus 1, may be provided in an electronic device such as a smartphone, a tablet terminal, or a personal computer that can communicate with the measurement apparatus 1, or may be provided in a server device that can communicate with the measurement apparatus 1 and the electronic device.

Although the embodiment of the present invention has been described in detail above, the above description is merely an example of the present invention in all respects. Various improvements and modifications may be made without departing from the scope of the present invention.

The present disclosure includes following configurations.

(1) A wearable measurement apparatus including:

a wireless communication interface configured to execute wireless communication with an information terminal;

a detector configured to detect a stationary state of the measurement apparatus; and a controller configured to cause the wireless communication interface to transmit an advertisement signal for the wireless communication when the stationary state is detected by the detector.

According to (1), when it is detected that the state of the measurement apparatus becomes the stationary state, the advertisement signal for starting the wireless communication is transmitted. Therefore, it is possible to transmit the advertisement signal without requiring a specific operation performed by the user, and the convenience is improved. Since the advertisement signal is not transmitted when the measurement apparatus is not in the stop state, the power consumption may be reduced.

(2) The measurement apparatus according to (1), in which the detector detects the stationary state due to a user wearing the measurement apparatus stopping an activity.

According to (2), it is possible to smoothly transfer data, which is often executed immediately after the user has stopped the activity, by transmitting the advertisement signal when the user stops the activity.

(3) The measurement apparatus according to (1) or (2), in which the detector detects the stationary state due to a user wearing the measurement apparatus removing the measurement apparatus.

According to (3), by transmitting the advertisement signal when the measurement apparatus is removed from the user, data transfer, which is often executed immediately after the removal, may be executed smoothly.

(4) The measurement apparatus according to any one of (1) to (3), further including:

a measurer configured to measure an activity of a user wearing the measurement apparatus, in which the stationary state is a stationary state of the measurement apparatus after the activity.

According to (4), it is possible to smoothly transfer data, which is often executed immediately after the end of the activity of the user, by transmitting the advertisement signal after the activity.

(5) The measurement apparatus according to any one of (1) to (4), in which, in a case where there is no transmission data to the information terminal, the controller stops the transmission of the advertisement signal performed in response to the stationary state being detected.

According to (5), it is possible to reduce the transmission period of the advertisement signal and to reduce the power consumption.

(6) A non-transitory computer-readable storage medium storing a control program for a wearable measurement apparatus including a wireless communication interface configured to execute wireless communication with an information terminal and a detector configured to detect a stationary state of the measurement apparatus, the control program causing a processor of the measurement apparatus to execute:

processing of causing the wireless communication interface to transmit an advertisement signal for the wireless communication in response to the stationary state being detected by the detector.

According to (6), since the advertisement signal for starting the wireless communication may be transmitted when the stationary state of the measurement apparatus is detected, the advertisement signal may be transmitted without requiring a specific operation performed by the user, and the convenience can be improved. Since the advertisement signal is not transmitted when the measurement apparatus is not in the stop state, the power consumption may be reduced.

According to aspects of the present disclosure, it is possible to provide a measurement apparatus and a non-transitory computer readable medium storing a control program that are capable of improving user convenience in a wearable measurement apparatus and reducing power consumption.

Although various embodiments have been described above, it goes without saying that the present invention is not limited to these examples. It is apparent to those skilled in the art that various changes or modifications may be conceived within the scope described in the claims, and it is understood that the changes or modifications naturally fall within the technical scope of the present invention. In addition, the components described in the above embodiment may be freely combined without departing from the spirit of the invention.

What is claimed is:

1. A wearable measurement apparatus comprising:

a wireless communication interface configured to execute wireless communication with an information terminal;

a detector configured to detect a stationary state of the measurement apparatus; and a controller configured to cause the wireless communication interface to transmit an advertisement signal for receiving, from the information terminal, a connection request to switch to one-to-one connection communication between the measurement apparatus and the information terminal in response to the stationary state being detected by the detector.

2. The measurement apparatus according to claim 1, wherein the detector detects the stationary state due to stopping of an activity of a user wearing the measurement apparatus.

3. The measurement apparatus according to claim 1, wherein the detector detects the stationary state due to removing of the measurement apparatus of a user wearing the measurement apparatus.

4. The measurement apparatus according to claim 1, further comprising:

a measurer configured to measure an activity of a user wearing the measurement apparatus, wherein the stationary state is a stationary state of the measurement apparatus after the activity.

5. The measurement apparatus according to claim 1, wherein, in a case where there is no transmission data to the information terminal, the controller stops the transmission of the advertisement signal performed in response to the stationary state being detected.

6. A non-transitory computer-readable storage medium storing a control program for a wearable measurement apparatus including a wireless communication interface configured to execute wireless communication with an information terminal and a detector configured to detect a stationary state of the measurement apparatus, the control program causing a processor of the measurement apparatus to execute a process comprising:

causing the wireless communication interface to transmit an advertisement signal for receiving, from the information terminal, a connection request to switch to one-to-one connection communication between the measurement apparatus and the information terminal in response to the stationary state being detected by the detector.

* * * * *